US010821747B1

(12) United States Patent
Mieney et al.

(10) Patent No.: US 10,821,747 B1
(45) Date of Patent: Nov. 3, 2020

(54) PRINTER HAVING AN AQUEOUS INK DRYING SYSTEM THAT ATTENUATES IMAGE QUALITY DEFECTS

(71) Applicant: Xerox Corporation, Norwalk, CT (US)

(72) Inventors: Christopher Mieney, Rochester, NY (US); David S. Derleth, Webster, NY (US); Santokh S. Badesha, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 16/435,670

(22) Filed: Jun. 10, 2019

(51) Int. Cl.
*B41J 11/00* (2006.01)
*B41J 2/01* (2006.01)

(52) U.S. Cl.
CPC ..... *B41J 11/002* (2013.01); *B41J 11/007* (2013.01); *B41J 2/01* (2013.01); *B41J 2202/20* (2013.01)

(58) Field of Classification Search
CPC . B41J 11/002; B41J 11/007; B41J 2/01; B41J 2202/20
See application file for complete search history.

(56) References Cited

U.S. PATENT DOCUMENTS 3,885,785 A 5/1975 Burkett et al.
5,280,308 A 1/1994 Takahashi et al.
5,548,388 A 8/1996 Schieck
5,631,685 A * 5/1997 Gooray ..... B41J 11/002 101/488
5,699,707 A 12/1997 Campbell, Jr.
7,207,558 B2 * 4/2007 Edinger ..... B65H 11/005 271/197
7,922,174 B2 4/2011 Panides et al.
8,695,783 B2 4/2014 Gilmartin et al.
9,665,138 B2 5/2017 Delano et al.
10,189,283 B2 * 1/2019 Zirilli ..... B65H 5/224
2016/0349808 A1 12/2016 Daly et al.

* cited by examiner

*Primary Examiner* — Sharon Polk
(74) *Attorney, Agent, or Firm* — Maginot Moore & Beck LLP

(57) ABSTRACT

A printer includes a drying unit that has a vacuum plenum and a drying belt with an exterior surface along which the media is transported through the drying unit. The drying belt has a plurality of holes extending through the drying belt, each hole in the plurality of holes having a diameter that is less than 300 microns. The drying unit further includes a heater configured to heat the media transported through the drying unit and a vacuum blower operably connected to the vacuum plenum. The vacuum blower is configured to generate a negative pressure in the vacuum plenum that holds the media on the exterior surface of the drying belt by the negative pressure acting through the plurality of holes without producing temperature differentials in the media on the belt that result in noticeable image quality defects.

16 Claims, 6 Drawing Sheets

PRINTER HAVING AN AQUEOUS INK DRYING SYSTEM THAT ATTENUATES IMAGE QUALITY DEFECTS

TECHNICAL FIELD

This disclosure relates generally to aqueous inkjet printing, and, in particular, to drying systems for the jetted aqueous ink.

BACKGROUND

In general, inkjet printing machines or printers include at least one marking unit having one or more printheads that eject drops or jets of liquid ink onto a recording or image forming surface. An aqueous inkjet printer employs water-based or solvent-based inks in which pigments or other colorants are suspended or in solution. Once the aqueous ink is ejected onto an image receiving surface by a printhead, the water or solvent is evaporated to stabilize the ink image on the image receiving surface.

Ejected aqueous ink is evaporated in dryer units that are located downstream of the marking unit. The dryer units include a heater that increases the temperature of the ink to evaporate the water or solvents. The media may be transported through the dryer unit by a plurality of belts having holes through which vacuum pressure can be applied to the media to retain the media on the belt while the heat is applied. Such belts, however, can affect the drying of the water or solvents differentially at different areas of the belts and can cause ink over the holes or at the edges of the belts to dry differently than the ink over the solid areas of the belt. These differences can cause visible image quality defects in a printed image. Therefore, drying units that dry jetted aqueous ink more uniformly would be beneficial.

SUMMARY

In one embodiment, a printer includes a marking unit and a drying unit that has a drying belt with small diameter holes. The marking unit comprises at least one printhead configured to eject aqueous ink onto media moving in a process direction as the media passes the at least one printhead. The drying unit comprises a vacuum plenum and the drying belt having an exterior surface over which the media is transported through the drying unit. The drying belt has a plurality of holes extending through the drying belt, each hole in the plurality of holes has a diameter that is less than 300 microns. The drying unit further includes a heater configured to heat the media transported through the drying unit and a vacuum blower operably connected to the vacuum plenum and configured to generate a negative pressure in the vacuum plenum that holds the media on the exterior surface of the drying belt by the negative pressure acting on the media through the plurality of holes.

In another embodiment, a drying unit has a belt with small diameter holes. The drying unit comprises a vacuum plenum and the drying belt, which has an exterior surface over which media sheets are transported through the drying unit. The drying belt has a plurality of holes extending through the drying belt, each hole in the plurality of holes having a diameter of less than 300 microns. The drying unit further comprises a heater configured to heat the media transported through the drying unit and a vacuum blower operably connected to the vacuum plenum and configured to generate a negative pressure in the vacuum plenum that holds the media on the exterior surface of the drying belt by the negative pressure acting on the media sheets through the plurality of holes.

In yet another embodiment, a method of operating an aqueous ink printer comprises moving media in a process direction through a marking unit, ejecting aqueous ink onto the media with at least one printhead, and transporting the media through a drying unit using a drying belt having a plurality of holes extending through the drying belt. Each hole of the plurality of holes has a diameter of less than 300 microns, operating a vacuum blower operatively connected to a vacuum plenum to apply a negative pressure through the plurality of holes in the drying belt to retain the media on an exterior surface of the drying belt, and heating the media with a heater as the media is transported through the drying unit to evaporate water or solvents in the aqueous ink.

DETAILED DESCRIPTION

Figure 1:
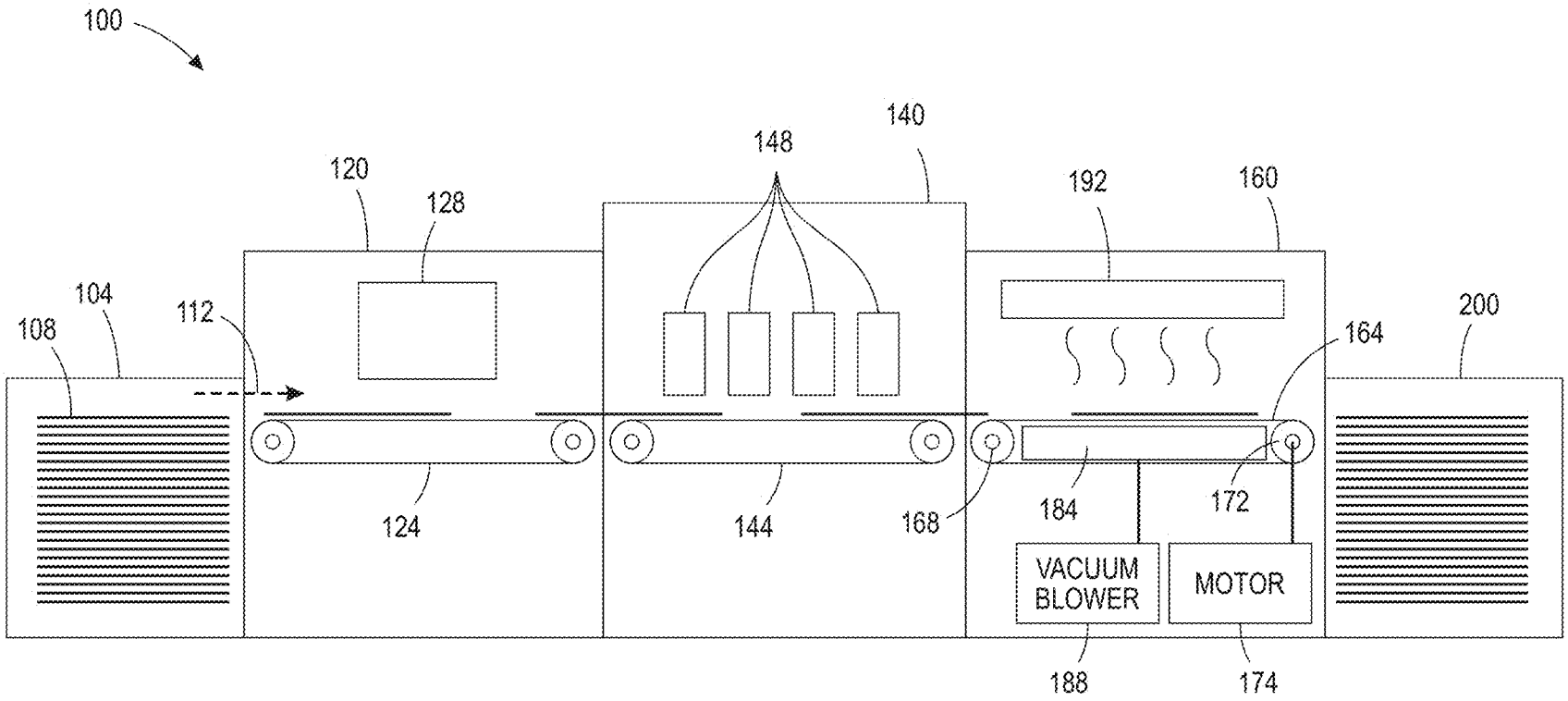
FIG. 1 is a schematic side view of a printer having a drying unit with a microporous drying belt.

For a general understanding of the present embodiments, reference is made to the drawings. In the drawings, like reference numerals have been used throughout to designate like elements. As used herein, the terms "printer," "printing device," or "imaging device" generally refer to a device that produces an image on print media with aqueous ink and may encompass any such apparatus, such as a digital copier, bookmaking machine, facsimile machine, multi-function machine, or the like, which generates printed images for any purpose. Image data generally include information in electronic form that are rendered and used by a controller to operate the inkjet ejectors in printheads to form an ink image on the print media. These data can include text, graphics, pictures, and the like. The operation of producing images with colorants on print media, for example, graphics, text, photographs, and the like, is generally referred to herein as printing or marking. Aqueous inkjet printers use inks that have a high percentage of water or solvent relative to the amount of colorant in the ink.

The term "printhead" as used herein refers to a component in the printer that is configured with inkjet ejectors to eject ink drops onto an image receiving surface. A typical printhead includes a plurality of inkjet ejectors having micro-actuators that eject ink drops of one or more ink colors onto the image receiving surface in response to firing signals that operate the micro-actuators in the inkjet ejectors. The inkjets are arranged in an array of one or more rows and columns. In some embodiments, the inkjets are arranged in staggered diagonal rows across a face of the printhead. Various printer embodiments include one or more printheads that form ink images on an image receiving surface. Some printer embodiments include a plurality of printheads arranged in a print zone. An image receiving surface, for example, a surface of the media, moves past the printheads in a process direction through the print zone. The inkjets in the printheads eject ink drops in rows in a cross-process direction, which is perpendicular to the process direction in the plane of the image receiving surface. As used in this document, the term "aqueous ink" means liquid inks in which colorant is in solution with water or one or more solvents.

FIG. 1 illustrates a high-speed aqueous ink image producing machine or printer 100 that uses a microporous drying belt. The printer 100 includes a media supply 104, a pretreating unit 120, a marking unit 140, a drying unit 160, and a media receptacle 200. The media supply 104 stores a plurality of media sheets 108 for printing by the printer 100. The media sheets 108 may, in some embodiments, be clay-coated paper.

The pretreating unit 120 includes at least one transport belt 124, which receives the media sheets 108 from the media supply 104 and transports the media sheets 108 in a process direction 112 through the pretreating unit 120. The pretreating unit 120 includes one or more pretreating devices 128 that condition the media sheets 108 and prepare the media sheets 108 for printing in the marking unit 140. The pretreating unit 120 may include, for example, one or more of a coating device that applies a coating to the media sheets 108, a drying device that dries the media sheets 108, and a heating device that heats the media sheets 108 to a predetermined temperature. In some embodiments, the printer 100 does not include a pretreating unit 120 and media sheets 108 are fed directly from the media supply 104 to the marking unit 140. In other embodiments, the printer 100 may include more than one pretreating unit.

Figure 2:
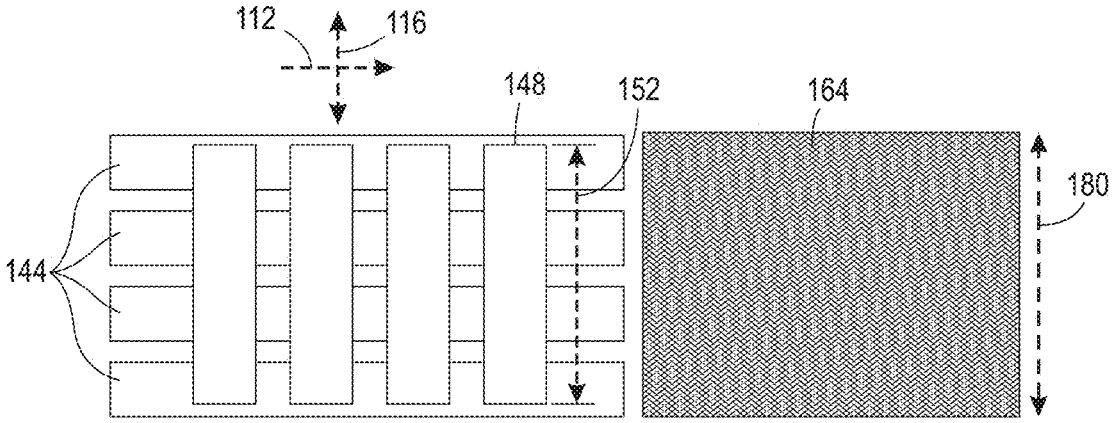
FIG. 2 is a schematic top plan view showing the inside of the marking unit and the drying unit of the printer of FIG. 1.

The marking unit 140 includes at least one marking unit transport belt 144 (four are illustrated in the embodiment of FIGS. 1 and 2) that receives the media sheets 108 from the pretreating unit 120 or the media supply 104 and transports the media sheets 108 through the marking unit 140. The marking unit 140 further includes at least one printhead 148 that ejects aqueous ink onto the media sheets 108 as the media sheets 108 are transported through the marking unit 140. In the illustrated embodiment, the marking unit 140 includes four printheads 148, each of which ejects one of cyan, magenta, yellow, and black ink onto the media sheets 108. The reader should appreciate, however, that other embodiments include other printhead arrangements, which may include more or fewer printheads, arrays of printheads, etc. As illustrated in FIG. 2, the printheads 148 are configured to eject the ink onto the media sheets across a maximum printing width 152 measured in the cross-process direction 116.

Referring back to FIG. 1 and with continuing reference to FIG. 2, a drying belt 164 of the drying unit 160 receives the media sheets 108 from the marking unit 140. The drying belt 164 is tensioned between two rollers 168, 172, one of which, for example roller 172, is driven by an electric motor 174 and the other of which, for example roller 168, is an idler roller. In some embodiments, the drying belt 164 is tensioned between the two rollers 168, 172 with a tension force of at least 500 N, and in other embodiments the drying belt is tensioned with a tension force of at least 600 N.

The drying belt 164 is formed with a plurality of holes 176 defined through the drying belt 164. In one embodiment, each of the holes 176 has a diameter of less than 300 microns. In another embodiment, each of the holes 176 has a diameter of less than 200 microns. In yet another embodiment, each of the holes 176 has a diameter of between approximately 50 microns and approximately 150 microns. In a particular embodiment, each of the holes 176 has a diameter of approximately 100 microns. As used herein, the term "approximately" refers to values that are within ±20% of the reference value.

Figure 3:
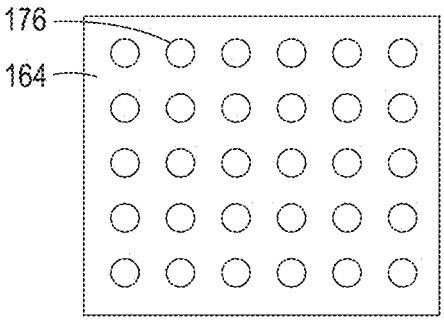
FIG. 3 is a top detail view of the drying belt of the drying unit of FIG. 1.
Figure 4:
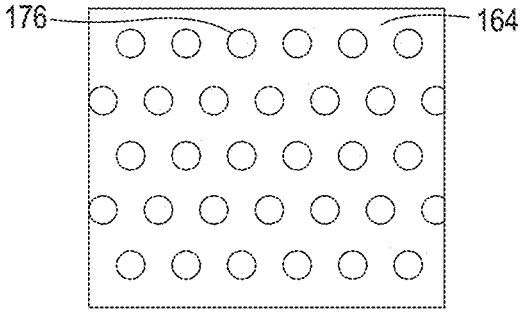
FIG. 4 is a top detail view of an alternative embodiment of the drying belt in the drying unit of FIG. 1.

The holes 176 may, in some embodiments, be of uniform size and distribution. FIG. 3 depicts, for example, a detail view of an arrangement of the holes 176 arranged in a uniform grid throughout the drying belt 164. In the uniform grid, each row extends across the width of the drying belt 164 and is aligned with the adjacent rows such that the holes 176 are formed in a square grid. In another embodiment, illustrated in FIG. 4, the holes 176 are arrayed in an offset pattern in which each row of holes is offset from the previous row. The holes 176 may be uniformly spaced apart from one another, or the holes may be concentrated in particular areas of the drying belt 164.

In some embodiments, the holes 176 are larger in certain areas of the belt than in others. For example the holes 176 may be larger at a side of the belt remote from the connection of a vacuum connection due to pressure differentials across the vacuum plenum. In particular, in embodiments in which the vacuum plenum 184 connects to the vacuum blower or the plumbing that is connected to the vacuum blower 188 at one side in the cross-process direction, the holes 176 may be larger at the opposite side in the cross-process direction due to the relatively lower pressure in the vacuum plenum 184 at the opposite side in the cross-process direction.

The total area of the holes 176 in the drying belt 164 may be, for example, greater than approximately 0.15% of the overall surface area of the exterior surface of the drying belt 164. In one embodiment, the total area of the holes 176 is between approximately 0.15% and 0.50% of the overall surface area of the exterior surface of the drying belt 164. In one particular embodiment, the total area of the holes 176 may be between approximately 0.19% and approximately 0.30% of the overall surface area of the exterior surface. As a result, the air moving through the holes 176 is sufficient to hold the media sheets 108 on the exterior surface of the drying belt 164 as the drying belt 164 passes over the vacuum platen 184 without producing image quality defects in the printed image.

The holes 176 may be formed in the drying belt 164 by, for example, laser drilling. In another embodiment, the holes 176 are mechanically formed in the drying belt 164 by a mechanical drilling apparatus, for example by punching. In yet another embodiment, the holes 176 may be formed by a chemical process, for example chemical etching.

As illustrated in FIG. 2, the drying belt 164 has a width 180 in the cross-process direction 116 that is equal to or greater than the maximum printing width 152 of the printheads 148. In one embodiment, the belt width 180 may be, for example, between approximately 300 mm and approximately 500 mm, though the belt width may be different in other printers depending on the print width and the size of the drying unit. In one particular embodiment, the belt width may be approximately 385 mm.

While the illustrated embodiment depicts a single drying belt 164 in the drying unit 160, the reader should appreciate that the drying unit may, in other embodiments, include at least two drying belts 164 arranged adjacent to one another in the process direction 112. For example, the drying unit 160 may include two or three equal-length drying belts 164 arranged one after another in the process direction 112, each drying belt 164 mounted on a different set of rollers. In one embodiment, the drying belt 164 is seamless and has an overall circumferential length of between approximately 500 mm and approximately 1500 mm, through in other embodiments the circumferential length may be different depending on the size of the drying unit. In one particular embodiment, the overall circumferential length of the drying belt 164 may be approximately 935 mm.

The drying belt 164 is formed from a temperature resistant material with suitable tensile strength. In some embodiments, the drying belt 164 is formed of a polymer material. In another embodiment, the drying belt 164 is formed of polyimide. In a further embodiment, the drying belt 164 is formed of a polyamide-polyimide composite material. In some embodiments, the drying belt 164 has a thickness of between approximately 75 microns and approximately 200 microns. As discussed in detail below, the thickness and material of the drying belt 164 provides sufficient tensile strength for the drying belt 164, while not being so thick as to cause an insulating effect when drying the media sheets 108.

The material of the drying belt 164 may, in some embodiments, further include conductive particles embedded in the material. In one particular embodiment, the drying belt 164 is a polyimide or a polyamide-polyimide composite having carbon black particles interspersed throughout the polyimide or polyamide-polyimide composite so as to increase the electrical conductivity of the drying belt 164. Additionally or alternatively, the polymer material of the drying belt 164 may also include nonconductive particles or fillers such as silica and titania, conductive but non-infrared absorbing particles or fillers such as indium oxides, tin oxides and their composites, and/or electrically conducting polymeric systems such as polyanilines and polyacetylenes, conductive metals or their metal oxides.

In some embodiments, the material of the drying belt 164, in particular the polymer of which the drying belt 164 is formed, does not have a coating on the exterior side, i.e., the side on which the media sheets 108 are transported. Thus, the media sheets 108 directly contact the exterior surface of the polymer.

In some embodiments, the exterior surface of the drying belt 164 is relatively smooth. For example, the exterior surface of the drying belt 164 may have a surface roughness Ra of less than 1 micron. In one particular embodiment, the exterior surface of the drying belt 164 has a surface roughness Ra of approximately 0.5 microns.

The drying unit 160 includes a vacuum plenum 184, which is fluidly connected to a vacuum blower 188. The vacuum blower 188 produces a negative pressure in the vacuum plenum 184. The negative pressure in the vacuum plenum 184 acts on the media sheets 108 present on the exterior surface of the drying belt 164 through the plurality of holes 176 to retain the media sheets 108 flat on the drying belt 164 without buckling, cockling, wrinkling, or other distortions in the media sheets 108.

The drying unit 160 further includes a heater 192 that heats the media sheets 108 to a temperature sufficient to evaporate the water or solvents in the aqueous ink in an amount that adheres the ink image to the sheets without buckling or cockling during the passage through the drying unit 160. The heater 192 may include, for example, one or more infrared heating elements directed at the drying belt 164 and the media sheets 108 thereon to increase the temperature of the media sheet. In some embodiments, the infrared heating elements may produce more than 10 kW of infrared energy directed at the drying belt 164. In one particular embodiment, the infrared heating elements produce approximately 14 kW of infrared energy directed at the drying belt 164. In other embodiments, the heater 192 may include a different type of heating element, for example a radiant near infrared heater or a forced hot air convection heater. The heater 192 may be configured to maintain the temperature at the drying belt 164 at approximately 200° C. during operation.

As the media sheets 108 are fed onto the drying belt 164 from the marking unit 140, the negative pressure in the vacuum plenum 184 acts through the holes 176 onto the media sheets 108 to exert a retaining force on the media sheets 108 and hold the media sheets 108 on the exterior surface of the drying belt 164 and avoid buckling, cockling, wrinkles, or other distortions in the media sheets that could reduce the quality of the final printed product. In addition, the heat produced by the heater 192 in combination with the airflow through the media sheets caused by the negative pressure serves to evaporate the water and solvents in the aqueous ink, leaving only the ink colorants of the printed image on the media sheets 108.

The drying unit 160 may be configured such that the media sheets 108 are in the drying unit 160 for between approximately 0.25 seconds and approximately 1 second so as to evaporate the desired amount of water or solvents from the ink. The drying unit 160 may therefore have a length in the process direction 112 of between approximately 300 mm and approximately 700 mm, and be driven by the driven roller 172 to rotate at a speed of between approximately 0.75 meters per second and approximately 2.0 meters per second.

Once the media sheets 108 reach the end of the vacuum plenum 184, the holes 176 are blocked by the roller 172 so the negative pressure ceases to act on the media sheets 108, and the media sheets 108 can transfer from the drying belt 164 and be deposited into the media receptacle 200. In some embodiments, the media sheets 108 may be transferred to one or more post-processing units prior to being deposited in the media receptacle 200 to, for example, treat, coat, or invert the media sheet 108 and return the media sheet 108 to the marking unit 140 to be imaged on the reverse side.

Figure 5:
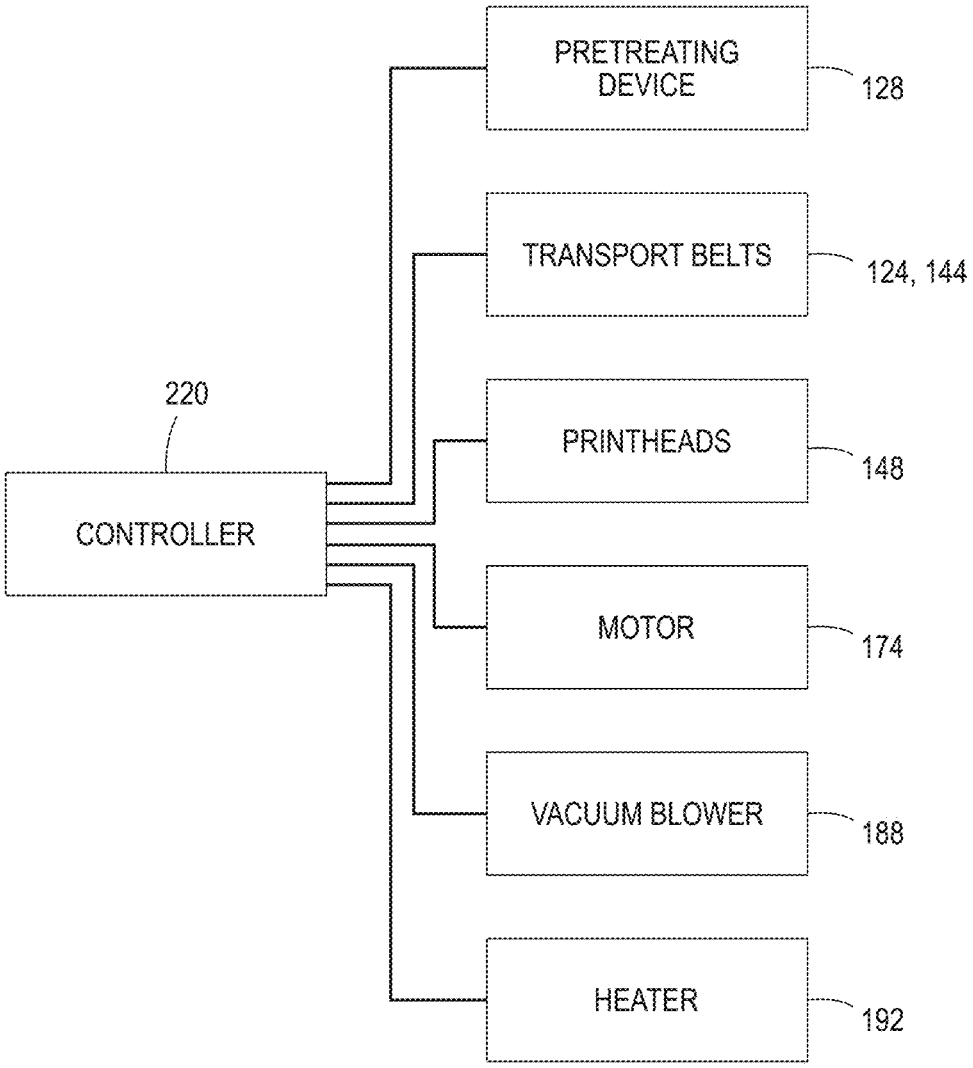
FIG. 5 is a schematic depiction of the control components of the printer of FIG. 1.

Operation and control of the various subsystems, components and functions of the machine or printer 100 described herein are performed with the aid of a controller or electronic subsystem (ESS) 220. As depicted in FIG. 5, the ESS or controller 220 is operably connected to the components of the printer 100, for example the pretreating device 128, the transport belts 124, 144, the printheads 148, the electric motor 174 of the driven roller 172, the vacuum blower 188, and the heater 192. The controller 220 is implemented with a general or specialized programmable processor that executes programmed instructions. In some embodiments, the controller includes more than one general or specialized programmable processor. The instructions and data required to perform the programmed functions are stored in a memory unit associated with the controller. The processor, memory, and interface circuitry configure the controller 220 to perform the functions disclosed above and the processes described below. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits.

Figure 6:
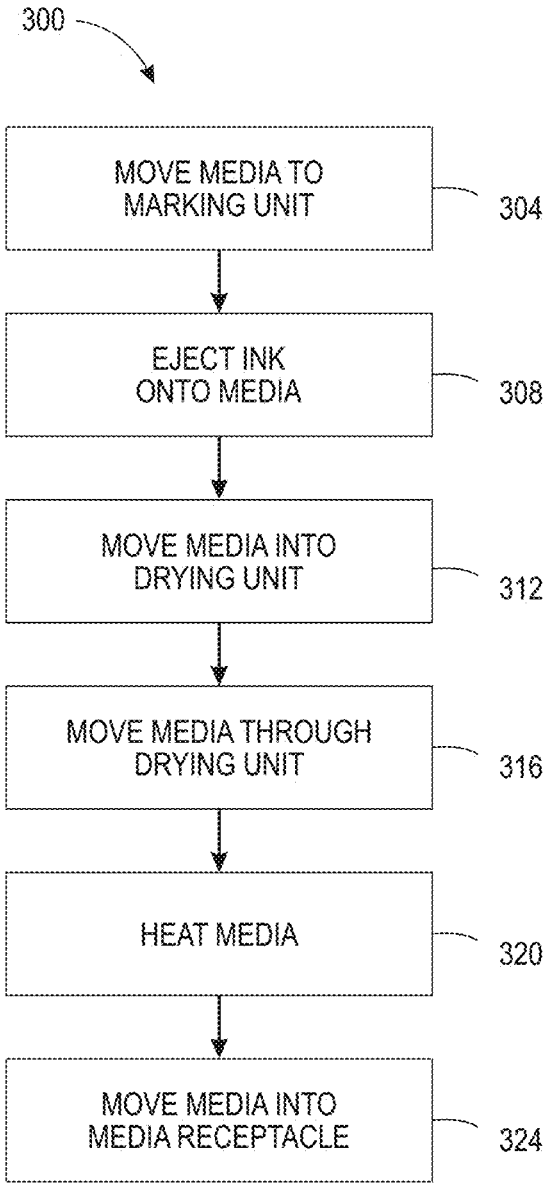
FIG. 6 is a flow diagram of a process for operating a printer such as the printer of FIG. 1.

A process 300 for printing an ink image on a media sheet is shown in FIG. 6. In the discussion below, a reference to the process 300 performing a function or action refers to the operation of a controller, such as controller 220, executing stored program instructions to perform the function or action in association with other components in the printer. The process 300 is described as being performed by the printer 100 of FIGS. 1-2 for illustrative purposes.

The process 300 begins with the controller 220 operating the transport belts 124, 144 to move the media sheet 108 from the media supply 104 to the marking unit 140 (block 304). The controller 220 may optionally operate a pretreating unit such as the pretreating unit 120 to pretreat the media sheet 108 while the media sheet 108 is being transported to the marking unit 140.

The controller 220 then operates the printheads 148 to eject ink onto the media sheet 108 (block 308). After the ink is ejected onto the media sheet 108, the media sheet 108 is moved to the drying unit 160 by, for example, continued operation of the transport belt 144 (block 312).

Once the media sheet 108 arrives at the drying unit 160, the controller 220 operates the printer 100 to move the media sheet 108 through the drying unit. The controller 220 operates the electric motor 174 to drive the driven roller 172, thereby rotating the drying belt 164. The controller 220 also operates the vacuum blower 188 to generate a negative pressure in the vacuum plenum 184. The negative pressure in the vacuum plenum 184 acts through the plurality of holes 176 in the drying belt 164 to retain the media sheet 108 on the drying belt 164 as the drying belt 164 is rotated about the rollers 168, 172.

As the media sheet 108 is moved through the drying unit 160, the controller 220 operates the heater 192 to generate heat in the drying unit 160. The heat generated in the drying unit 160, in addition to the air moved through the holes 176 by the vacuum blower 188 aids in evaporating the water and solvents in the aqueous ink, such that the media sheet 108 retains only the colorants from the ink by the time the media sheet 108 exits the drying unit 160. Upon exiting the drying unit 160, the printed media sheet 108 is deposited in the media receptacle 200 for storage.

Figure 7:
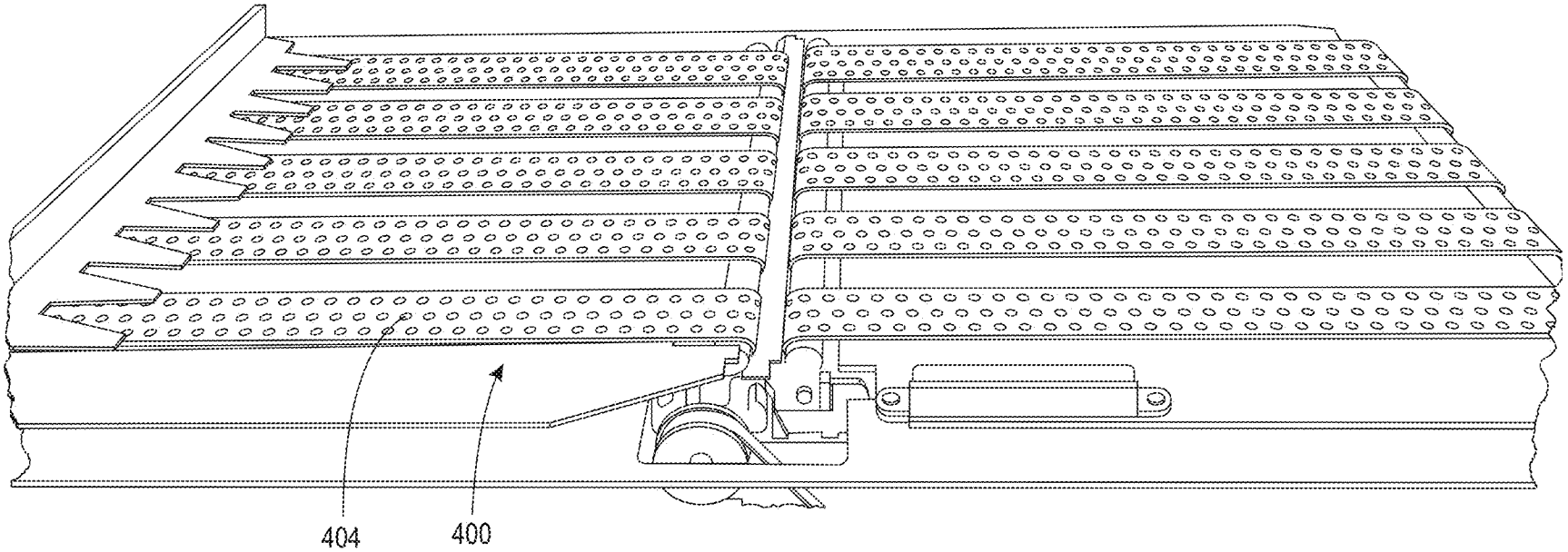
FIG. 7 (PRIOR ART)
FIG. 7 is a perspective view of a prior art drying unit.
Figure 8:
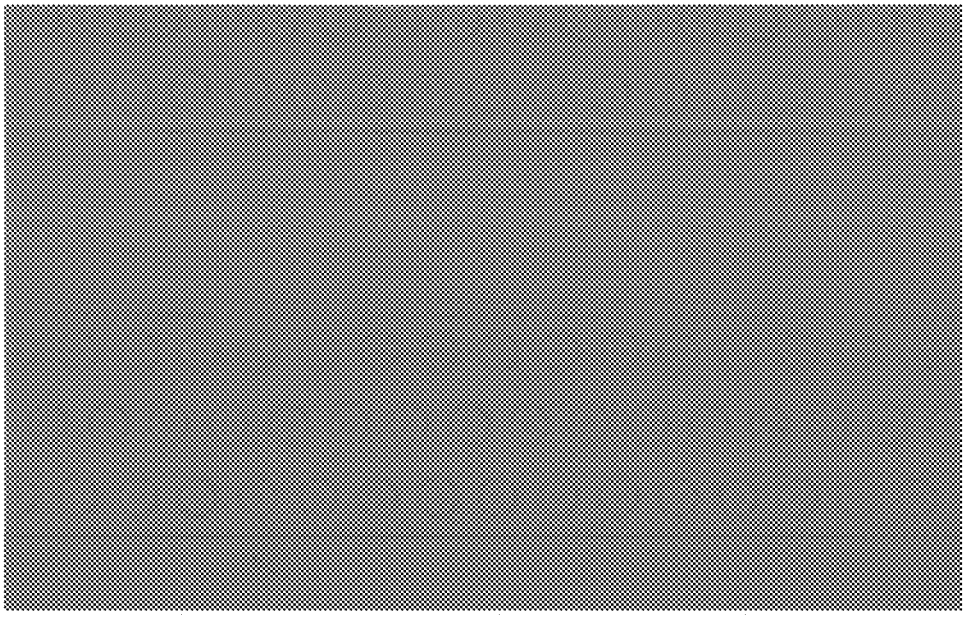
FIG. 8 (PRIOR ART)
FIG. 8 is an illustration of an image defect caused by the prior art drying unit of FIG. 7.

In conventional drying units, a plurality of narrow silicone belts 400 (FIG. 7) are arranged parallel to one another in the cross-process direction. Each of the belts 400 has relatively large holes 404 having diameter of approximately 6-10 mm. During transport through the conventional drying unit, the airflow through the holes 404 and at the edges of the belts 400 can cause temperature gradients to form at these locations. In particular, since the portions of the media sheets located over the holes 404 or at the edges of the belts 400 are exposed to the airflow through the holes 404 or around the belts 400 rather than the heated drying belts 400, these portions of the media sheets remain at a lower temperature than the portions of the media sheet in contact with the belts 400. The water and solvents of the ink on portions of the media sheets in contact with the belts therefore evaporate more quickly than the remaining water and solvents, which causes the ink to absorb into the media better and more uniformly in the portions of the media sheets in contact with the belts 400. This uneven drying of the ink results in visible image defects as illustrated in FIG. 8.

Recent ink formulations have lower boiling points than prior ink formulations to produce a higher image quality across a wide range of substrates. For instance, the inks may have boiling points between approximately 20° C. and approximately 70° C. depending on the color of the ink as compared to previous inks that have boiling points between approximately 60° C. and 80° C. The reduced boiling points of the ink can cause the water and solvents in the ink to evaporate more quickly when exposed to the heating of typical drying units. Consequently, the time the inks rest on the media for absorption in the media is reduced. The resulting greater quantity of ink on the media coupled with the different evaporation rates of the water and solvents at different areas on the belt can cause the pigment to coalesce in some areas and not in others. The drying belt with significantly smaller hole diameters attenuates these differences and reduces the resulting image quality defects.

In addition, coated media sheets, for example gloss or clay coated media, are less porous and less absorbent than uncoated media sheets. As a result, unabsorbed ink rests in greater quantities on these type of media sheets than on uncoated media sheets. The combination of lower boiling point inks and coated media results can exacerbate the uneven drying effects that cause the pigment to coalesce on the media due to the temperature gradients at the edges and holes of the belts. The smaller diameter holes in the drying belt described above help prevent the uneven drying effects from this combination of inks and media from causing image quality defects.

As illustrated in FIG. 2, the drying belt 164 of the printer 100 is a single seamless belt with a width 180 that is greater than the maximum printing width 152. As a result, the drying belt 164 has no edges within the printed area at which temperature gradients can form during the drying process. Accordingly, the ink dries more uniformly across the width of the drying belt 164. Moreover, since the holes 176 in the drying belt 164 have very small diameters, for example less than 300 microns, less than 200 microns, or approximately 100 microns, the area over which temperature gradients exist at the holes 176 is miniscule, thereby reducing or eliminating the resulting image defects. Any remaining image defects are so small as to be imperceptible to the human eye.

Inks, oils, dust, and debris in the printer 100 can accumulate on the drying belt 164 and in the holes 176 of the drying belt 164 during continued operation of the printer 100. Since the drying belt 164 is smooth (i.e. has a low surface roughness Ra of, for example, less than 1 micron or less than 0.5 microns), conventional solvents and cleaners can be used on the drying belt 164. As a result, the time and expense required to maintain the drying belt 164 is reduced.

When higher evaporation temperature inks are used, the drying belt 164 may be subjected to constant temperatures of approximately 200° C. and tensile forces of approximately 600 N in the drying unit 160. Moreover, the drying belt 164 may be rotated at speeds in excess of approximately 4 to approximately 5 feet per second to produce a desired page throughput in the printer 100. The combination of material and thickness of the drying belt 164 is therefore configured to withstand the tensile forces and temperatures present in the drying unit 160 and to rotate at the high speeds required without damage to the drying belt 164. Additionally, the drying belt 164 should be thick enough to retain enough heat when it receives the thermal load of the media sheets 108 passing through the drying unit 160 that enough ink is evaporated from the media sheets 108 so image offsetting and system contamination does not occur. A drying belt that is too thick, however, may produce a thermal insulating effect so too much time is required to heat the belt to the desired drying temperature or, if the heater 192 has been heating the drying belt 164 prior to the printing process, the extra thermal mass of the thicker drying belt can cause the heated drying belt to be hotter during the first few prints, thereby further increasing the drying speed of the inks and potentially causing image defects. To prevent these effects, the drying belt 164 is formed of polyimide or a polyamide-polyimide composite having a thickness between approximately 75 microns and 200 microns. The drying belt 164 is therefore of sufficient material strength and thickness to withstand the high temperatures, tensile stresses, and speed in the drying unit 160, but is not so thick as to cause a thermal insulating effect.

In addition, since coatings on the belt may break down in the high temperatures and tensile forces to which the drying belt 164 is subjected in the drying unit 160, in some embodiments, the polyimide or polyamide-polyimide composite of the drying belt 164 is uncoated to retain the temperature and force stability of the polyimide or polyamide-polyimide composite material. In other words, since the drying belt 164 is uncoated, the exterior surface of the drying belt 164, which is contacted by the media sheets 108 and is exposed to the infrared heat from the heater 192, is formed only with the polyimide or polyamide-polyimide composite and is not coated at all.

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A printer comprising:

a marking unit comprising at least one printhead configured to eject aqueous ink onto media moving in a process direction as the media passes the at least one printhead, the at least one printhead defines a maximum printing width in a cross-process direction;

a drying unit comprising:

a vacuum plenum;

a drying belt having an exterior surface over which the media is transported through the drying unit, the drying belt having a width in the cross-process direction that is greater than the maximum printing width in the cross-process direction and the exterior surface of the drying belt has a surface roughness Ra of less than 1 micron, the drying belt has a plurality of holes extending through the drying belt, each hole in the plurality of holes has a diameter that is less than 300 microns;

a heater configured to heat the media transported through the drying unit; and a vacuum blower operably connected to the vacuum plenum and configured to generate a negative pressure in the vacuum plenum that holds the media on the exterior surface of the drying belt by the negative pressure acting on the media through the plurality of holes.

2. The printer of claim 1 wherein the surface roughness Ra of the exterior surface of the drying belt is approximately 0.5 microns.

3. The printer of claim 2 wherein each hole has a diameter of between 50 microns and 250 microns.

4. The printer of claim 3 wherein the drying belt is formed of polyimide or a polyamide-polyimide composite.

5. The printer of claim 4 wherein the drying belt has a thickness of between approximately 75 microns and approximately 200 microns.

6. The printer of claim 5 wherein the drying belt is uncoated.

7. The printer of claim 6 wherein the drying belt is tensioned to a force of at least 500 N.

8. The printer of claim 7 wherein the polyimide or the polyamide-polyimide composite is interspersed with at least one of an electrically conductive infrared absorbing particulate material and an electrically conductive non-infrared absorbing filler material.

9. The printer of claim 8 wherein the heater is an infrared heater that generates at least 10 kW of infrared energy directed at the exterior surface of the drying belt.

10. A drying unit for a printer comprising:

At least one printhead, the at least one printhead defining a maximum printing width in a cross-process direction;

a vacuum plenum;

a drying belt having an exterior surface over which media sheets are transported through the drying unit, the drying belt having a width in the cross-process direction that is greater than the maximum printing width and the exterior surface of the drying belt has a surface roughness Ra of less than 1 micron, the drying belt has a plurality of holes extending through the drying belt, each hole in the plurality of holes has a diameter that is less than 300 microns;

a heater configured to heat the media transported through the drying unit; and a vacuum blower operably connected to the vacuum plenum and configured to generate a negative pressure in the vacuum plenum that holds the media on the exterior surface of the drying belt by the negative pressure acting on the media sheets through the plurality of holes.

11. The drying unit of claim 10 wherein each hole has a diameter of between 50 microns and 250 microns.

12. The drying unit of claim 11 wherein the drying belt is formed of polyimide or a polyamide-polyimide composite.

13. The drying unit of claim 12 wherein the drying belt has a thickness of between approximately 75 microns and approximately 200 microns.

14. The drying unit of claim 13 wherein the drying belt is uncoated.

15. The drying unit of claim 14 wherein the drying belt is tensioned to a force of at least 500 N.

16. A method of operating an aqueous ink printer comprising:

moving media in a process direction through a marking unit having at least one printhead configured to eject aqueous ink onto media moving in a process direction as the media passes the at least one printhead, the at least one printhead defining a maximum printing width in a cross-process direction;

ejecting aqueous ink onto the media using the at least one printhead;

transporting the media through a drying unit using a drying belt having a width in the cross-process direction that is greater than the maximum printing width, an exterior surface of the drying belt having a surface roughness Ra of less than 1 micron, and a plurality of holes extending through the drying belt, each hole in the plurality of holes having a diameter of less than 300 microns;

operating a vacuum blower operatively connected to a vacuum plenum to apply a negative pressure through the plurality of holes in the drying belt to retain the media on an exterior surface of the drying belt; and heating the media with a heater as the media is transported through the drying unit to evaporate water or solvents in the aqueous ink.

* * * * *